US007017771B1

(12) United States Patent
Kothera et al.

(10) Patent No.: US 7,017,771 B1
(45) Date of Patent: Mar. 28, 2006

(54) PRESSURE VESSEL

(75) Inventors: Kenneth R. Kothera, Mentor, OH (US); George S. Ellis, Chardon, OH (US); Christian Gargiulo, Mentor, OH (US)

(73) Assignee: ESSEF Corporation, Chardon, OH (US)

( * ) Notice: Subject to any disclaimer, the term of this patent is extended or adjusted under 35 U.S.C. 154(b) by 189 days.

(21) Appl. No.: 10/348,426

(22) Filed: Jan. 21, 2003
(Under 37 CFR 1.47)

Related U.S. Application Data

(60) Provisional application No. 60/354,819, filed on Feb. 6, 2002.

(51) Int. Cl.
*F17C 1/16* (2006.01)

(52) U.S. Cl. ..... 220/581; 220/661

(58) Field of Classification Search ..... 220/661
See application file for complete search history.

(56) References Cited

U.S. PATENT DOCUMENTS 4,358,377 A 11/1982 Clark
4,537,329 A * 8/1985 Norton ..... 220/661
4,614,279 A * 9/1986 Toth et al. ..... 220/590
4,717,035 A 1/1988 Dirkin et al.
4,739,899 A 4/1988 Thompson et al.
4,958,957 A * 9/1990 Berg et al. ..... 405/55
4,989,741 A * 2/1991 Dull et al. ..... 220/1.5
5,320,238 A 6/1994 Verdesca et al.
5,653,358 A 8/1997 Sneddon
5,720,411 A 2/1998 Darby et al.
6,074,595 A 6/2000 Eisberg et al.
6,165,303 A 12/2000 Darby et al.

* cited by examiner

*Primary Examiner*—Stephen Castellano
(74) *Attorney, Agent, or Firm*—Pearne & Gordon LLP

(57) ABSTRACT

A pressure vessel having a relief area onto which a flange of a side port can be attached. The relief area includes a planar mating surface raised from the cylindrical sidewall of the vessel. A method for forming the pressure vessel includes providing a cylindrical mandrel provided with a side port spacer. Fiberglass is wrapped onto the mandrel and space. The fiberglass is impregnated with resin and the resin is cured. A metallic insert ring is embedded in a full bore open end of the pressure vessel. The ring has a cross-section having a height to width ratio of less than 0.7.

9 Claims, 3 Drawing Sheets

PRESSURE VESSEL

CROSS-REFERENCE TO RELATED APPLICATION(S)

This application claims the benefit of U.S. Provisional Patent Application Ser. No. 60/354,819 filed on Feb. 6, 2002.

BACKGROUND OF THE INVENTION

This invention relates to pressure vessels having at least one open end and to end closures and side ports therefor. More specifically, it relates to cylindrical pressure vessels designed for reverse osmosis pressure driven filtration operations, particularly to vessels which provide full-bore access to accept elongated, cylindrical filtration media cartridges. Even more particularly, it relates to improved end closure arrangements for such pressure vessels. It also relates to methods for making such pressure vessels of this general type and particularly to those designed for pressure driven filtration operations, especially filtration using filter cartridges, and more particularly to making vessels suited for sidewall porting to provide fluid flow couplings through the cylindrical sidewall of the pressure vessel.

Cylindrical pressure vessels have many industrial applications, including use in the field of filtration. Vessels used in filtration are often of the type made from a resin-coated fiberglass shell and having a fully open end that must be closed by a separate closure. Further, one or more side ports are often attached to a cylindrical side wall of such a vessel.

There are a variety of approaches used in the industry to anchor these side ports into vessels with fully open ends. They include threading into the body wall, counterboring a relief from the inside into which a flange of the port can reside, forming a concentric relief during the winding which will serve to pocket the port flange, and overmolding sealing material onto the vessel.

It is desirable to seal the port flange against the inside wall of the pressure vessel. The inside wall is rich in resin and provides a good seal. However, since the wall cylindrical, a special ring or other sealing means is necessary to provide an adequate seal, thus adding to the overall cost of production.

Counterboring creates a flat surface allowing standard o-rings or other less-expensive sealing means to be used. However, counterboring cuts into structural glass fibers which weakens the vessel.

Providing a concentric relief can require a difficult to produce side port flange design, also adding to the overall cost of production.

Further, regarding high pressure vessels, it is common in the industry to imbed a metallic ring in the composite shell of a full-bore opening vessel to provide a place to anchor the end closure. An example is shown in U.S. Pat. No. 5,720,411, wherein a metallic annular element is fixedly imbedded in a shell. Low-pressure units can be fabricated without such an insert ring.

As the burst test pressure requirements elevate considerably, in those configurations with the end closure seal adjacent to the insert ring, the exact configuration of the insert ring becomes crucial. That is, for 8" diameter vessels that must only survive test pressures up to 3600 psig there are a variety of configurations that function satisfactorily. These same insert rings have been shown to be inadequately retained as test pressures approach 6000 psig, in vessels of the same inside diameter.

SUMMARY OF THE INVENTION

The present invention provides a pressure vessel comprising a cylindrical side wall formed from resin-coated fiberglass and a relief area onto which a flange of a side port can be attached, the relief area extending outward from the cylindrical side wall. The vessel further comprises a planar mating surface at an outside extent of the relief area, and a bore in the mating surface for accommodating a cylindrical port having a flange.

According to another aspect, the present invention provides a method of forming a resin-coated fiberglass pressure vessel having a relief area in a cylindrical sidewall of the vessel. The method comprises the steps of: providing a mandrel having a cylindrical forming surface; providing a side port spacer on the mandrel, the side port spacer having a proximate end that conforms to and mates with the cylindrical forming surface of the mandrel and having a planar distal end for forming a mating surface of the relief area; winding a fiberglass material around the mandrel and the spacer to form a cylindrical pressure vessel having a relief area; impregnating the fiberglass material with a resin; and curing the resin.

According to yet another aspect, the present invention provides a metallic insert ring for imbedding in the full bore open end of a composite pressure vessel. The insert ring comprises a generally annular body, a cross section of the body having a height extending radially to the body and a width extending axially to the body, and an annular groove in an inside surface of the body. A ratio of the height to the width is less than 0.7.

DETAILED DESCRIPTION OF THE INVENTION

Figure 1A:
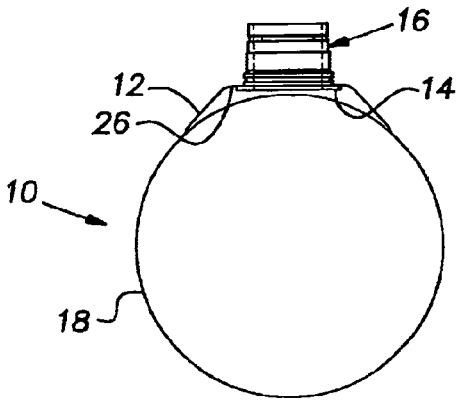
FIG. 1A is a front elevational view of a pressure vessel according to the present invention.
Figure 1B:
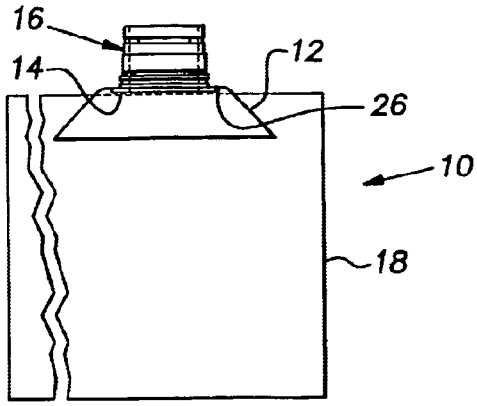
FIG. 1B is a side elevational view of the pressure vessel of FIG. 1A.
Figure 2A:
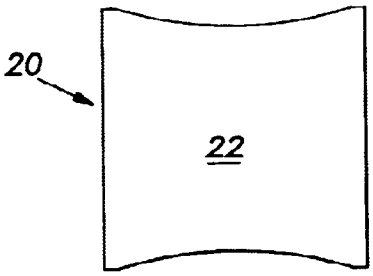
FIG. 2A is bottom view of a side port spacer according to the present invention.
Figure 2B:
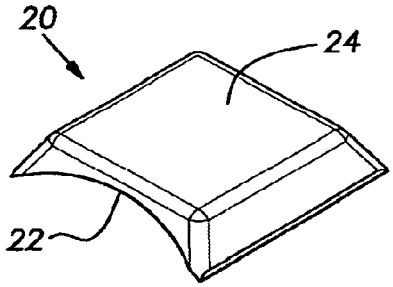
FIG. 2B is a perspective view of the side port spacer of FIG. 2A.
Figure 2C:
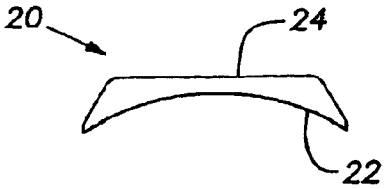
FIG. 2C is a front elevational view of the side port spacer of FIG. 2A.
Figure 2D:
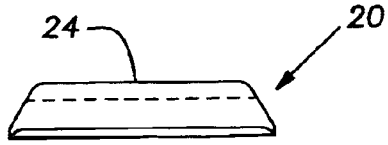
FIG. 2D is a side elevational view of the side port spacer of FIG. 2A.
Figure 3A:
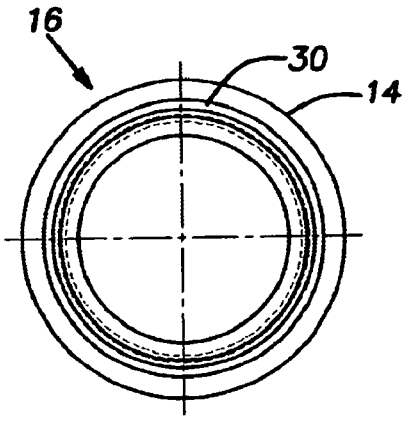
FIG. 3A is a front elevational view of a side port for a pressure vessel according to the present invention.
Figure 3B:
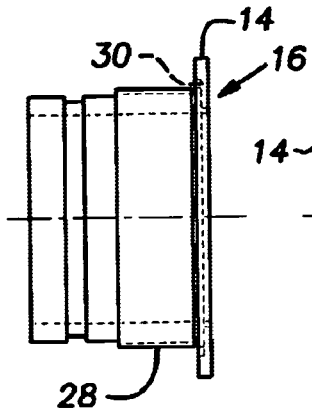
FIG. 3B is a side elevational view of the side port of FIG. 3A.
Figure 3C:
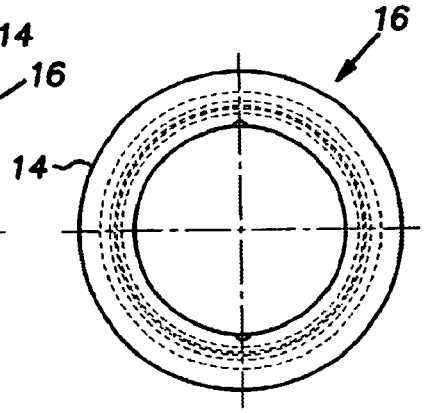
FIG. 3C is a rear elevational view of the side port of FIG. 3A.

Referring to FIGS. 1A, 1B, 2A–2D, 3A–3C, and 6, the present invention provides a method and apparatus for forming a pressure vessel 10 having a relief area 12 onto which a flange 14 of a side port 16 can be attached.

Examples of pressure vessels of the type used in the present invention are disclosed in commonly owned U.S. Pat. Nos. 6,165,303 and 5,720,411 to Darby et al., the disclosures of which are specifically incorporated herein by reference. The present method and apparatus provides a more efficient, lower cost approach to providing a relief area than known methods. The present invention results in a configuration which more effectively utilizes the glass fibers of the pressure vessel shell 18 than known configurations.

According to the present invention, a cylindrical mandrel (not shown) of a known design is used as a form upon which to build the pressure vessel shell 18. A side port spacer 20 is provided having a concave surface 22 of a shape which is complementary to the cylindrical surface of the mandrel. Thus, the side port spacer 20 is designed to conform intimately to the cylindrical mandrel. Further, the side port spacer has a flat surface 24 opposing the concave surface 22.

To form the pressure vessel 10, the side port spacer 20 is placed on the mandrel. Then, reinforcing fibers combined with a resin, such as fiberglass wound with thermoplastic resin fibers or a thermosetting impregnating resin, are wound around the mandrel and side port spacer 20. The resin is then hardened, forming a rigid pressure vessel shell 18. In the case of fiberglass wound with thermoplastic resin fibers, the resin is sintered or melted under the influence of heat and then cooled, allowing the heat-softened thermoplastic to harden. Other reinforcing fibers, such as glass, carbon, KEVLAR (available from Dupont), metal, aramid, silicon carbide and boron may also be used. Suitable thermoplastic fibers include, for example, polyethylene, polybutylene terephthalate, polyethylene terephthalate and nylon. Alternatively, thermoset plastics, such as epoxy, vinyl ester and polyester, can be used in place of the thermoplastic fibers.

The finished pressure vessel shell 18 is removed from the mandrel and the side port spacer 20 is removed from the shell 18. A flat surface 26 formed on the inside of the cylindrical shell side wall corresponds to the flat surface 24 of the side port spacer 20.

A port hole is formed in the flat surface 26 of the pressure vessel shell 18. The side port 16 having an annular flange 14 is inserted through the port hole. The side port flange 14 bears and seals against the flat surface 26 in the relief area 12 surrounding the port hole.

Further, the port hole is provided with an inside thread 27. The side port 16 is provided with a corresponding outside thread 28. Thereby, the side port 16 can be inserted and threaded into the port hole. An annular groove 30 in the side port flange 14 accommodates a standard o-ring 31. When the side port flange 14 is tightened against the flat surface 26 by way of the threads 28, the o-ring 31 is captured between the flat surface 26 and the flange 14 to provide a seal.

In addition to cost reduction, another advantage of the present invention over the prior art concentric relieved region is that the flat surface 26 permits the glass filaments that are capturing the port flange 14 to approach the loaded area at a steeper angle, and therefore carry a greater load.

Figure 4:
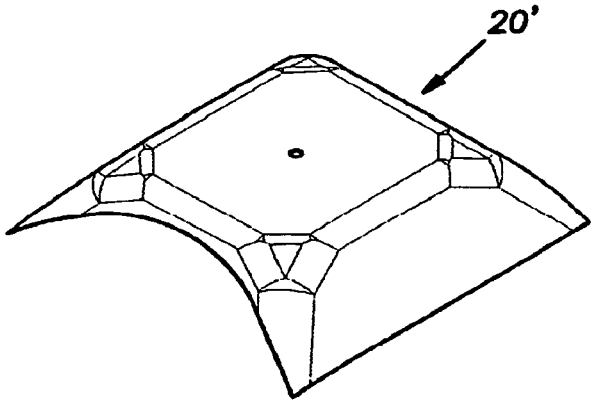
FIG. 4 is an additional embodiment of a side port spacer according to the present invention.

FIG. 4 shows an alternative embodiment of a side port spacer according to the present invention.

Figure 5:
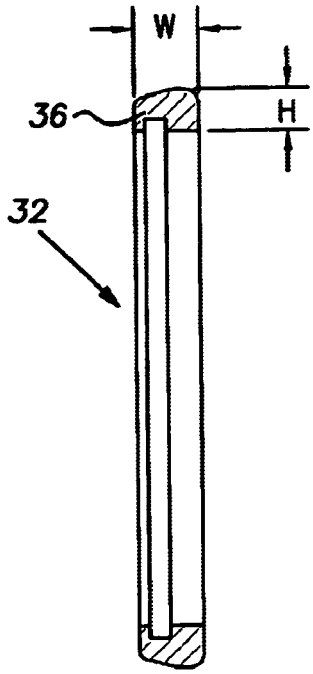
FIG. 5 is a cross-sectional view of an insert ring for a pressure vessel according to the present invention.
Figure 6:
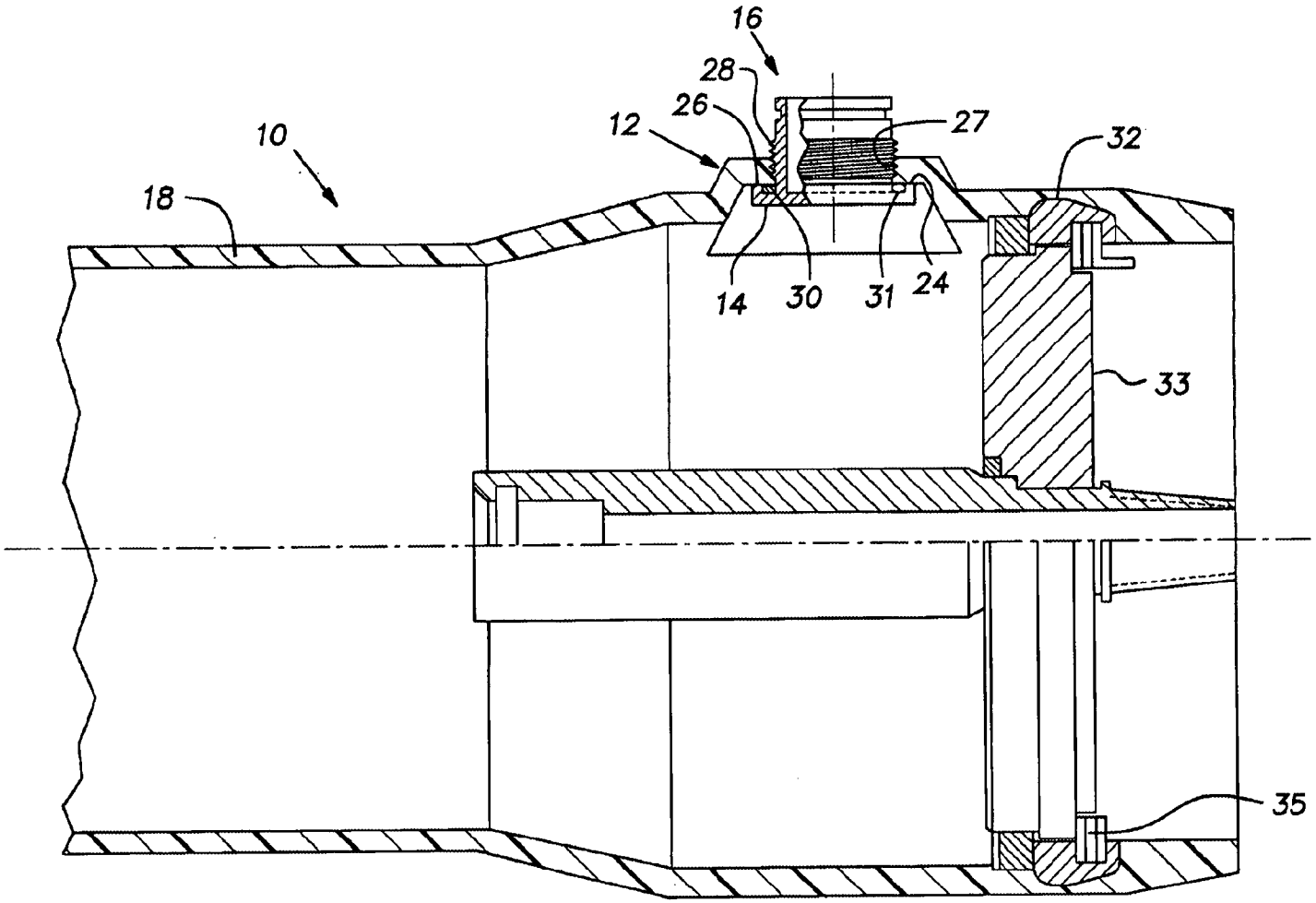
FIG. 6 is a cross-sectional view of a pressure vessel according to the present invention.

FIGS. 5 and 6 show a metallic insert ring 32 for imbedding in the composite shell 18 of a full-bore opening vessel 10. The ring 32 acts to reinforce the shell 18 where a closure 33 is attached. An inside annular groove 34 of the ring 32 also supports a locking ring 35 that holds the closure 33 in place.

The insert ring 32 has a cross-sectional radial height (H) to axial width (W) ratio of less than 0.7, as compared to prior art ratios of greater than 1.0. The lower ratio configuration moves the centroid of the insert ring's cross-sectional area 36 to a point which permits a reversal of the direction of the torque applied to the composite shell 18 by the loaded insert ring 32. The conventional insert ring, when loaded by the pressurized fluid within the vessel, applies a torque to the shell which concentrates a compressive bearing stress load adjacent to the inner diameter of the shell wall. Reversing the direction of the torque applied by the insert ring 32 on the shell shifts the maximum loading to the interior of the composite wall, i.e. the region adjacent to the outer diameter of the insert ring 32.

Another feature of the insert ring 32 is that it is shaped to minimize or eliminate the region adjacent to the ring 32 which would inherently be devoid of fiberglass due to the bridging of the fiberglass strands as they traverse the insert ring 32.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A pressure vessel comprising:

a cylindrical side wall formed from resin impregnated reinforcing fibers;

a generally cylindrical side port having an annular flange and an outside thread;

a relief area onto which the flange can be attached, the relief area extending outward from the cylindrical side wall;

a planar mating surface at an inside face of the relief area; and a threaded bore in the mating surface threadedly receiving the port and cooperating with the outside thread of the port.

2. The pressure vessel according to claim 1, wherein the flange comprises an annular groove for accommodating an o-ring.

3. The pressure vessel according to claim 1, further comprising:

an open end of the vessel;

a closure inserted within the open end; and an insert ring imbedded within a wall of the vessel at the open end, the insert ring comprising a generally annular body and a cross section of the body having a height extending radially to the body and a width extending axially to the body, wherein a ratio of the height to the width is less than 0.7.

4. The pressure vessel of claim 3, further comprising a locking ring that retains the closure within the vessel, wherein an annular groove in the insert ring accommodates the locking ring.

5. The metallic insert ring of claim 3, wherein an outside surface of the annular body is tapered inward along an axial direction of the body.

6. A pressure vessel comprising:

a cylindrical side wall formed from resin impregnated reinforcing fibers;

a generally cylindrical side port having an annular flange and an outside thread;

a relief area onto which the flange can be attached, the relief area extending outward from the cylindrical side wall;

a planar mating surface at an inside face of the relief area;

a threaded bore in the mating surface threadedly receiving the port and cooperating with outside thread of the port;

an open end of the vessel;

a closure inserted within the open end; and an insert ring imbedded within the side wall of the vessel at the open end, the insert ring comprising a generally annular body and a cross section of the body having a height extending radially to the body and a width extending axially to the body, wherein a ratio of the height to the width is less than 0.7.

7. The pressure vessel according to claim 6, wherein the cylindrical side wall and the relief area are formed as a unitary structure from the resin impregnated fibers.

8. The pressure vessel according to claim 6, wherein the flange comprises an annular groove for accommodating an o-ring.

9. The pressure vessel of claim 6, further comprising a locking ring that retains the closure within the vessel, wherein an annular groove in the insert ring accommodates the locking ring.

* * * * *